United States Patent [19]

Adachi

[11] 4,403,416

[45] Sep. 13, 1983

[54] CLOTH-CUTTING MACHINE

[75] Inventor: Shoichi Adachi, Osaka, Japan

[73] Assignee: N.C.A. Co., Ltd., Japan

[21] Appl. No.: 267,467

[22] Filed: May 27, 1981

[30] Foreign Application Priority Data

Feb. 6, 1981 [JP] Japan ..... 56-16363[U]
Feb. 6, 1981 [JP] Japan ..... 56-16364[U]
Feb. 6, 1981 [JP] Japan ..... 56-16365[U]

[51] Int. Cl.[3] ..... D06H 7/00; B26D 5/00

[52] U.S. Cl. ..... 30/273; 83/925 CC; 83/639

[58] Field of Search ..... 30/272 R, 273, 275, 30/282; 83/746, 925 CC, 563, 565, 639; 414/591, 732, 735, 744 R, 749, 751, 730, 590

[56] References Cited

U.S. PATENT DOCUMENTS

| | | | |
|---|---|---|---|
| 3,819,061 | 6/1974 | Andersson et al. | 414/591 |
| 3,951,271 | 4/1976 | Mette | 414/591 |
| 3,954,188 | 5/1976 | Boyle | 414/732 X |
| 4,092,777 | 6/1978 | Jung | 30/273 |
| 4,338,839 | 7/1982 | Farrell, Sr. et al. | 83/639 X |
| 4,339,975 | 7/1982 | Carrieri | 83/639 X |

*Primary Examiner*—Frederick R. Schmidt
*Assistant Examiner*—Debra S. Meislin
*Attorney, Agent, or Firm*—Steele, Gould & Fried

[57] ABSTRACT

A cloth-cutting machine designed to cut pieces of cloth on a working table by a cutting mechanism provided with an automatic cutter and capable of achieving effective cutting operation in any place on the working table without exerting any unbalanced load on the working table and also capable of effectively absorbing any vibration caused at the time of cutting operation.

1 Claim, 4 Drawing Figures

CLOTH-CUTTING MACHINE

BACKGROUND OF THE INVENTION

The present invention relates to a cloth-cutting machine designed to cut pieces of cloth on a working table by a cutting means provided with an automatic cutter wherein said cutting means is suspended above the working table to freely move in the horizontal direction, manual movement causing the cutter to cut pieces of cloth on the working table to a predetermined form.

There is well-known a cloth-cutting machine of this type wherein cutting means, having an automatic cutter, is suspended from a support arm which can move in the horizontal direction, at a certain distance from the upper surface of horizontal working table, manual movement causing the cutter to cut pieces of cloth on the working table to a predetermined form. In the case of cutting pieces of cloth by the cloth-cutting machine of this type, it is necessary that the cutting means can freely move on the working table. However, in the prior art machine the support arm for the cutting means was itself supported on one side of the working table. Therefore, the machine was inferior in working capability when the whole surface of working table was used to cut pieces of cloth. In addition, the support arm supported on one side of working table exerted an unbalanced load on the working table, tending to deform the table. Therefore, the working table must have a structure especially reinforced at the outset.

It is often necessary with the cloth-cutting machine of this type to move the cutting means over certain pieces of cloth on the working table which need not be cut, in order to reach other pieces of cloth which must be cut, termed a "fly-over" or "flying-over" operation. However, the prior art machine could not carry out such flying-over operation of the cutting means, making it necessary to move the cutting means so as to avoid certain pieces of cloth on the working table. This was a troublesome operation.

Further, the prior art machine employed compressed coil springs to absorb vibration caused at the time of cutting operation, but these compressed coil springs were not effective enough in vibration absorption to prevent deleterious effects on each of machine elements due to such unabsorbed vibration.

SUMMARY OF THE INVENTION

An object of the present invention is to provide a cloth-cutting machine capable of achieving effective cutting operation in any place on the working table without exerting any unbalanced load on the working table.

Another object of the present invention is to provide a cloth-cutting machine having a cutting means provided with an automatic cutter which can be moved flying over pieces of cloth on the working table and which is capable of certainly and effectively absorbing vibration caused at the time of cutting operation.

Another object of the present invention is to provide a cloth-cutting machine capable of utilizing extremely shorter air hoses through which compressed air is supplied from an air compressor to a cylinder means, and also capable of achieving excellent working capability without being hindered by the air compressor.

These and other objects and merits of the present invention will be apparent from the following detailed description with reference to the accompanying drawings.

DETAILED DESCRIPTION OF THE PREFERRED EMBODIMENT

Figure 1:
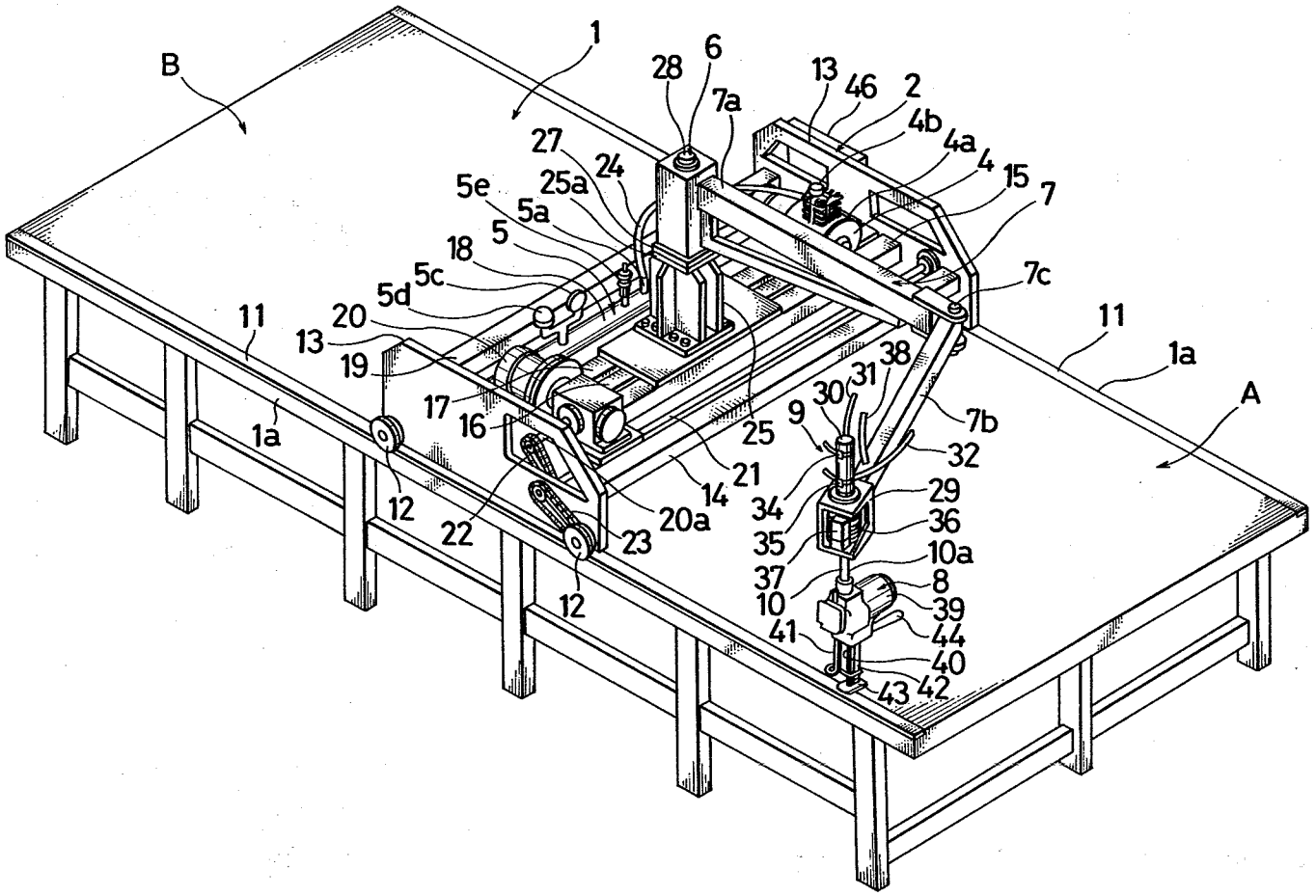
FIG. 1 is a perspective view showing an example of cloth-cutting machine according to the present invention.

A cloth-cutting machine according to the present invention comprises a carriage 2 mounted for reciprocal movement in the horizontal direction on a working table 1, a post 6 erected on the carriage 2, an arm member 7 extending in the transverse direction and attached for free horizontal rotation around the post 6, and a cutting means 8 suspended from the arm member 7 and having an automatic cutter 40.

The working table 1 has an upper rectangular surface horizontal to and spaced by a predetermined distance from the floor. Rails 11 and 11 are arranged on both longer sides 1*a* and 1*a* of working table 1. The carriage 2 is mounted on these rails 11 and 11 through wheels 12 which are attached to the four corners of carriage 2, respectively. The carriage 2 includes two side frames 13 and 13 each erected along the longer side of working table 1 and a plurality of horizontal frames 14, 15, 16, 17, 18 and 19 arranged between both side frames and spaced from the horizontal surface of working table 1.

A motor 20 is fixedly mounted on one side of horizontal frames 15, 16 and 17, and a shaft 20*a* driven by the motor 20 is connected through a chain 22 to a shaft 21, which is rotatably supported between both side frames 13 and 13 and which is connected through a chain 23 to wheels 12 of carriage 2 so as to allow the carriage 2 to reciprocate in the horizontal direction on the working table 1.

A motor section 4*a* and a compression section 4*b* for an air compressor 4 are fixedly attached to the other side opposite to the motor 20. An air tank 5 for storing air compressed by the compression section 4*b* of air compressor 4 is formed in one of horizontal frames for example, frame 18. Namely, the horizontal frame 18 is fixed at both sides thereof to both side frames 13 and 13 of carriage 2, respectively, and made formed from a cylindrical member having an air-tight hollow portion inside in which compressed air is stored. Frame 18 has sufficient structural strength to withstand the internal air pressure. The air tank 5 formed by the horizontal frame 18 includes an air inlet 5*a* connected via a hose 24 to the compression section 4*b* of air compressor 4, an outlet 5*b* through which compressed air stored inside is fed, a pressure gauge 5*c* for detecting the pressure of compressed air stored inside, a pressure detector 5*d* for generating signals responsive to values detected by the pressure gauge 5*c* to start or stop the operation of motor section 4*a* of air compressor 4, a safety valve 5*e* and a drain discharge 5*f*.

The post 6 is erected on the center portion of carriage 2 or of horizontal frames 15, 16 and 17. The post 6 comprises post supporting members 25 vertically erected on horizontal frames 15, 16 and 17 to have a predetermined height, a supporting plate 27 fixed to upper ends 25*a* of post supporting members 25 by means of bolts 26, and a vertical shaft 28 fixed on the supporting plate 27.

One end of a base portion 7*a* of support arm 7 which extends transversely from the vertical shaft 28 is attached via a bearing 171 to the shaft 28 in such a way that the support arm 7 can rotate horizontally about shaft 28. The support arm 7 comprises the base portion 7*a* and an end portion 7*b* which the rotatably connected relative to each other in the horizontal direction by means of a vertical pin 7*c*. The foremost end of end portion 7*b* of support arm 7 is attached integrally with a support frame 29, from which the cutting means 8 is suspended through an extensible cylinder means 9. The cylinder means 9 includes an air cylinder 30 fixed on the support frame 29, a piston (not shown) housed in the cylinder 30, and a rod 10 connected at the upper end thereof to the piston and extending downwards.

Figure 2:
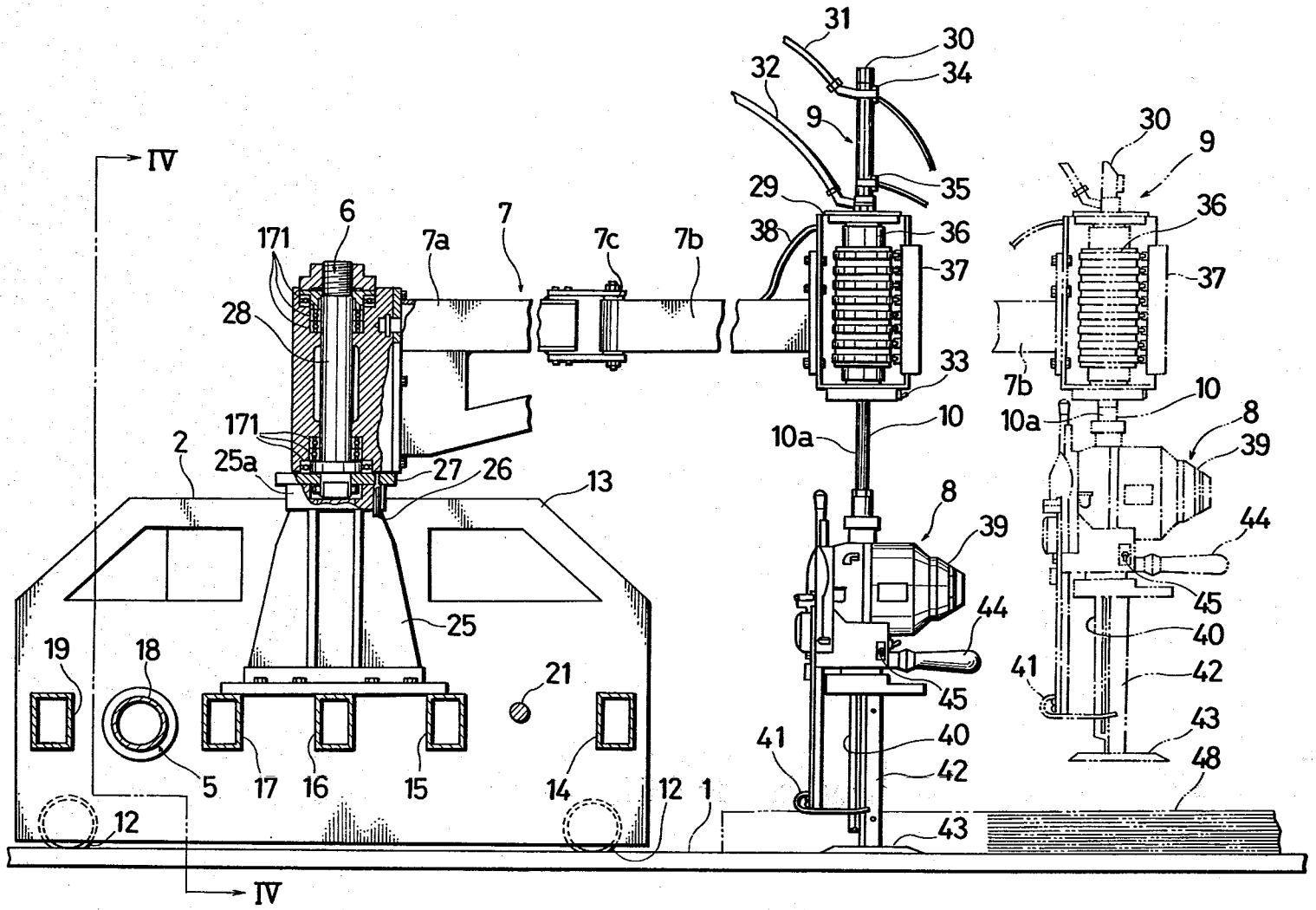
FIG. 2 is a partially cross-sectioned view viewing the cloth-cutting machine in FIG. 1 from one side thereof.

The cutting means 8 is attached to the lowermost end of rod 10 of cylinder means 9 in such a way that the cutting means 8 can be raised and lowered by the upward and downward movement of rod 10 from the lower position at which cutting operation is carried out and which is shown by a solid line in FIG. 2 and to the upper position at which flying-over operation is carried out and which is shown by dotted lines in FIG. 2.

A hose 31 connected to the upper end of cylinder 30 of cylinder means 9 and a hose 32 connected to the lower end thereof are connected at other ends thereof to the outlet 5*b* of air tank 5 for the air compressor 4 through an air controller 46, which serves to start or stop the supply of compressed air, and a hose 47, so that the supply of compressed air through hoses 31 and 32 to the cylinder 30 can be started or stopped by the operation of a changeover switch 33 and air controller 46, thus allowing the rod 10 to be raised or lowered.

Cutting and flying-over positions of cutting means 8 are determined by reed switches 34 and 35 which are arranged at upper and lower portions of air cylinder 30, respectively, and which serve to sense the position of the piston in the cylinder 30. When the cutting means 8 is to be raised from the cutting position shown by the solid line in FIG. 2 to the flying-over position shown by the dotted lines in FIG. 2, the changeover switch 33 is changed over to supply compressed air from the air tank 5 to the air cylinder 30 through the lower hose 32, hose 47 and air controller 46 while to discharge compressed air from the cylinder 30 through the upper hose 31; when the piston is raised to reach the position of upper reed switch 34, the upper reed switch 34 senses the piston position and supplies a signal to the air controller 46, which stops the discharge of compressed air through the upper hose 31 responding to the signal; and the piston is thus fixed in position by air pressure through upper and lower hoses 31 and 32 to a position corresponding to the upper reed switch 34, thus allowing the cutting means 8 attached to the lower end of rod 10 to be fixed in position at the flying-over position shown by the dotted lines in FIG. 2.

On the contrary, when the cutting means 8 is to be lowered from the flying-over position to the cutting position, the changeover switch 33 is reversed to supply compressed air from the air tank 5 to the cylinder 30 through the hose 47, air controller 46 and upper hose 31 while to discharge compressed air from the cylinder 30 through the lower hose 32; when the piston is lowered to reach the position of lower reed switch 35, the reed switch 35 senses the piston position and supplies a signal to the air controller 46, which stops the discharge of compressed air through the lower hose 32 responding to the signal; and the positon is fixed in position by air pressure through upper and lower hoses to a position corresponding to the lower reed switch 35, thus allowing the cutting means 8 to be fixed in the cutting position shown by the solid line in FIG. 2.

A slip ring 36 is arranged on rod 10 and a power supply cable 38 is connected via a terminal fitting 37 to the slip ring 36 so as to supply power from the slip ring 36 to a motor 39 which drives the cutting means 8. The rod 10 comprises a lower rod portion 10*a* rotating in and integral to the slip ring 36 and suspending the cutting means 8 from the lowermost end thereof, and an upper rod portion (not shown) connected at the upper end thereof to the piston, said upper and lower rod portions being connected to each other by a rod coupling which does not transmit the rotation of lower rod portion to the upper one.

The cutter 40 of cutting means 8 is reciprocated upwardly and downwardly at high speed by the motor 39 to cut pieces of cloth 48. The cutter 40 is of elongate shape and reciprocated up and down by transforming the rotating movement of motor 39 to up-and-down movement through a transmission or the like (not shown). A member 41, movable up and down to press pieces of cloth 48, is arranged crossing the cutter 40 and a foot plate 43 is attached to the lowermost end of a cutter guide 42, said cutter guide 42 serving to guide the up and down reciprocation of cutter 40 and said foot plate 43 moving integrally with the cutter guide 42 on the working table 1. A handle 44 is arranged projecting to a side opposite to the cutter blade of cutter 40 and a switch 45 is also arranged adjacent to the handle 44 to turn the motor 39 ON and OFF.

Wheels 12 are rotated by the motor 20 to move the carriage 2 to an operating position on the working table 1, with the cutting means 8 held at the elevated position shown by the dotted lines in FIG. 2. Changing over the changeover switch 33, compressed air is supplied through the upper hose 31 to the air cylinder 30 while discharged from the air cylinder 30 through the lower hose 32, thus causing the cutting means 8 to be lowered to the cutting position shown by the solid line in FIG. 2 and held there by positioning the piston corresponding to the lower reed switch 35 of air cylinder 30. The cutting means 8 lowered to the cutting position is held there by subjecting the piston in the air cylinder 30 to air pressure applied through upper and lower hoses 31 and 32. Therefore, the cutting means 8 suspended under this state from the cylinder means 9 can be moved to any desired place on the working table 1 by manually pushing the handle 44 to move the support arm 7 around the post 6 or the end portion 7*b* of support arm 7 around the vertical pin 7*c*, thus allowing the cutter 40 of cutting means 8 to cut pieces of cloth on the working table 1. As described above, the cutting means 8 is suspended from the cylinder means 9 and positioned by air pressure in the cylinder means 9, so that almost all of vibration caused at the process of cutting operation can be absorbed by the cylinder means 9 whose air cushioning action serves as a shock absorber.

When it becomes necessary in a cutting operation to raise the cutting means 8 and fly over pieces of cloth 48 on the working table 1, the changeover of changeover switch 33 causes compressed air to be supplied through the lower hose 32 to the air cylinder 30 while discharged from the air cylinder 30 through the upper hose 31, thus allowing the cutting means 8 to be elevated to the flying-over position shown by the dotted lines in FIG. 2 and held there by positioning the piston corresponding to the upper reed switch 34 of air cylinder 30. Therefore, the cutting means 8 is ready to fly over pieces of cloth 48 during the horizontal movement of support arm 7.

Figure 3:
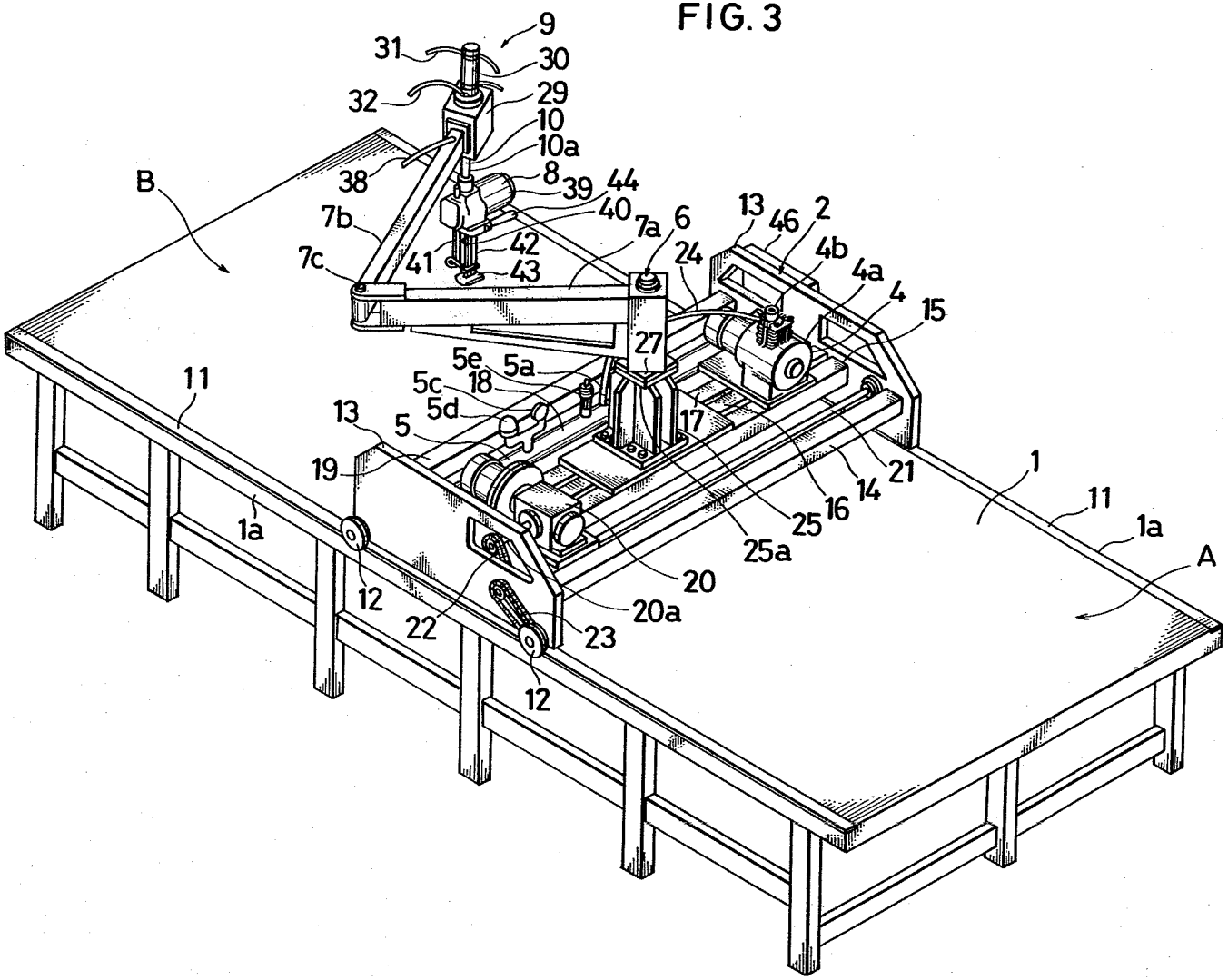
FIG. 3 is a perspective view similar to FIG. 1 and showing the cloth-cutting machine under another operating condition.
Figure 4:
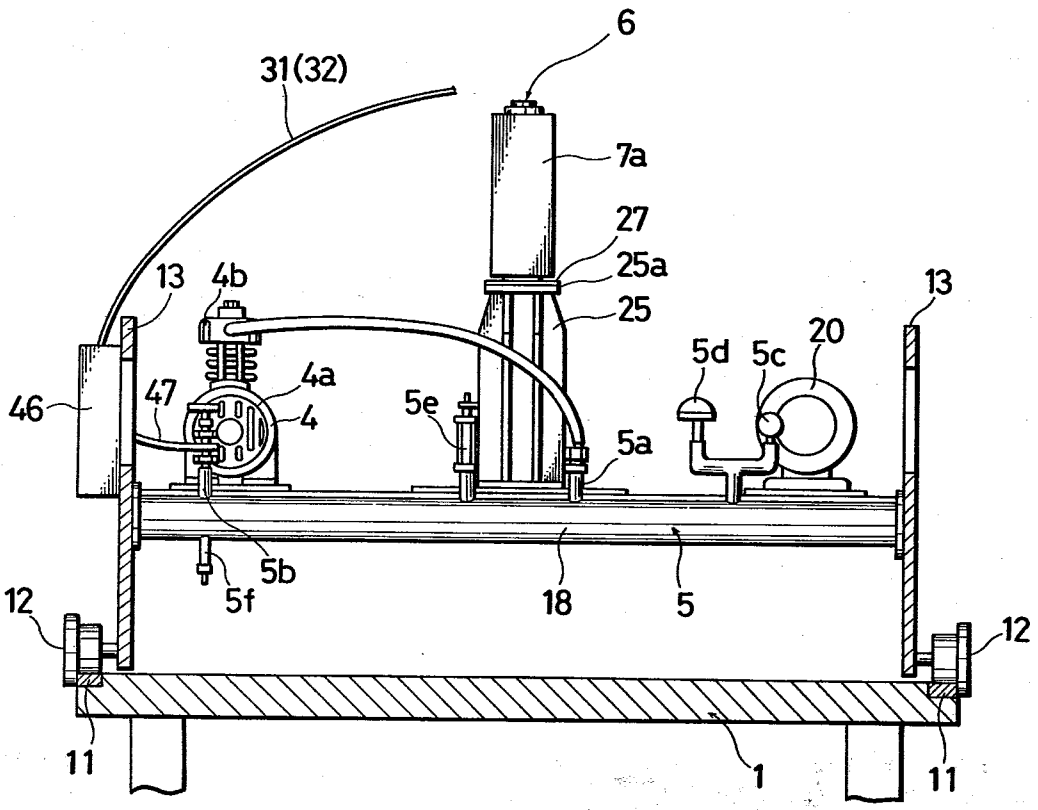
FIG. 4 is a cross-sectional view taken along the line IV—IV in FIG. 2.

The carriage 2 can move along the whole length of longer sides of working table 1 and the support arm 7 can be moved around the post 6 allowing the cutting means 8 to alternatively effect cutting operations at both sides of carriage 2 on the working table 1, that is, at both cutting spaces A and B on the table 1 as shown in FIGS. 1 and 3. Therefore, cutting operations can be effected at the one cutting space A or B on the working table 1 while other pieces of cloth are being made ready at the other cutting space B or A on the working table 1 to thereby enhance the efficiency of cutting operation.

The above-mentioned embodiment of the present invention has the post 6 erected on the center of carriage 2, but the post 6 may be erected at any desired place on the carriage 2. In addition, the support arm 7 movable around the post 6 may be rotated around the post 6 to an extent of allowing cutting operation to be alternatively effected at both sides of carriage 2 on the working table 1, that is, at cutting spaces A and B on the working table 1.

The cylinder means 9 may employ an oil pressure cylinder instead of air cylinder 30 and an air cushioning portion in which compressed air is sealed may be arranged on the way of oil pressure pipe in this case to absorb vibration caused at the process of cutting operation.

The air tank 5 of air compressor 4 may be formed in any of side frames 13 and 13, other horizontal frames 14, 15, 16, 17, 19 and post supporting members 25.

As described above, the cloth-cutting machine of the present invention comprises the carriage adapted to reciprocate in the horizontal direction on the working table, the post erected on the carriage, the support arm extending transversely from the post and attached freely rotatable in the horizontal direction to the post, and the cutting means having the automatic cutter and suspended from the support arm. Therefore, the load of the carriage can be prevented from being weight imbalanced on the working table, thus making it unnecessary to especially reinforce the working table, resulting in lower manufacturing costs. In addition, the cutting means can be easily moved to any desired position on the working table using the movement of the carriage and the rotation of the support arm to thereby efficiently achieve cutting operation in any place on the working table.

Further, the cutting means is suspended from the support arm through the cylinder means which allows the cutting means to move up and down between flying-over and cutting positions. Therefore, the cutting means can be elevated to the flying-over position by the action of cylinder means to fly over pieces of cloth on the working table at any time during cutting operation, thus allowing cutting operation to be achieved efficiently.

The air cushioning action of cylinder means via which the cutting means is suspended from the support arm effectively absorbs vibration caused at the time of cutting operation of cutting means to thereby effect cloth-cutting operation with high accuracy without subjecting the support arm and other elements to undue vibration.

Furthermore, the air compressor is mounted on the carriage and the air tank for storing air compressed by the air compressor, and for supplying compressed air to the cylinder means, is formed in one of the frames of the carriage. Therefore, hoses through which compressed air is supplied from the air compressor to the cylinder means can be made as short as possible and the air tank can be used as a frame of the carriage, thus allowing the compressed air supply means to be made very small. In addition, the air compressor mounted on the carriage does not disturb the operation of machine, enhancing working capacity.

What is claimed is:

1. A cloth-cutting machine, comprising:

a working table;

a carriage arranged for horizontal reciprocation over the table, the carriage having side frame members interconnected by a plurality of cross frame members, at least one of which is hollow;

an upstanding post disposed on at least one of the cross frame members of the carriage;

a support arm extending transversely from the post and mounted for horizontal rotation around the post;

extensible cylinder means having a cylinder affixed to the free end of the support arm and a piston assembly vertically reciprocable relative to the cylinder;

cutting means, having an automatic cutter, supported by the piston assembly of the cylinder means for vertical movement between a lower cutting position and an upper flying-over position, the cylinder means absorbing substantially all vibration due to operation of the cutting means, which would otherwise be transmitted back to the carriage and working table through the support arm and post; and, an air compressor mounted on at least one of the cross frames of the carriage, the at least one hollow frame member forming an integral compressed air tank for driving the piston assembly of the cylinder means between the upper and lower positions, whereby the cutting means may be selectively operated on and fly over the entire working table.

* * * * *

UNITED STATES PATENT AND TRADEMARK OFFICE

CERTIFICATE OF CORRECTION

PATENT NO. : 4,403,416

DATED : Sept. 13, 1983

INVENTOR(S) : Shoichi Adachi

It is certified that error appears in the above-identified patent and that said Letters Patent are hereby corrected as shown below:

Column 4, line 5, delete "position" (first occurrence) and insert --piston--.

Signed and Sealed this

*Twenty-ninth* Day of *January 1985*

[SEAL]

*Attest:*

DONALD J. QUIGG

*Attesting Officer*

*Acting Commissioner of Patents and Trademarks*